US010041511B2

(12) United States Patent
Beck et al.

(10) Patent No.: US 10,041,511 B2
(45) Date of Patent: Aug. 7, 2018

(54) PNEUMATIC DRIVE AND METHOD FOR ACQUIRING THE POWER OF A PNEUMATIC DRIVE

(71) Applicant: Bürkert Werke GmbH, Ingelfingen (DE)

(72) Inventors: Klaus Beck, Gommerdsdorf (DE); Sebastian Frank, Heuberg (DE); Andreas Ungerer, Forchtenberg (DE)

(73) Assignee: BÜRKERT WERKE GMBH (DE)

( * ) Notice: Subject to any disclaimer, the term of this patent is extended or adjusted under 35 U.S.C. 154(b) by 445 days.

(21) Appl. No.: 14/249,421

(22) Filed: Apr. 10, 2014

(65) Prior Publication Data

US 2014/0305298 A1 Oct. 16, 2014

(51) Int. Cl.
*F15B 19/00* (2006.01)
*F15B 15/14* (2006.01)

(52) U.S. Cl.
CPC ..... *F15B 15/14* (2013.01); *F15B 19/005* (2013.01); *F15B 2211/6313* (2013.01); *F15B 2211/6336* (2013.01); *F15B 2211/864* (2013.01); *F15B 2211/87* (2013.01); *F15B 2211/8855* (2013.01)

(58) Field of Classification Search
CPC ..... F15B 2211/6655; F15B 2211/87; F15B 2211/864
See application file for complete search history.

(56) References Cited

U.S. PATENT DOCUMENTS

2012/0116744 A1* 5/2012 Pfeiffer ..... G05B 17/02 703/13

FOREIGN PATENT DOCUMENTS

| | | |
|---|---|---|
| DE | 19644961 | 4/1998 |
| DE | 102008058208 | 5/2010 |
| EP | 2439602 | 4/2012 |

OTHER PUBLICATIONS

Resnick et al, Physics pp. 136-145, 438, 446, 624-625. John Wiley & SOns, INc, NY,© 1966.*
German Search Report dated Nov. 21, 2013 in German Patent Application No. 10 2013 006 220.9.

* cited by examiner

*Primary Examiner* — F. Daniel Lopez
(74) *Attorney, Agent, or Firm* — Plumsea Law Group, LLC

(57) ABSTRACT

A pneumatic drive and a method for acquiring the power of a pneumatic drive are specified. A piston is movably disposed in a working space and coupled to a path transducer. A pressure sensor is provided for acquiring an internal pressure of the working space. An evaluation unit of the pneumatic drive is adapted to process the value of a path distance of a movement of the piston acquired by the path transducer as well as a variation of the internal pressure in the working space acquired by the pressure sensor. The variation of the internal pressure is associated with the movement of the piston in the working space. Based on these values, a power of the pneumatic drive can be determined.

20 Claims, 3 Drawing Sheets

PNEUMATIC DRIVE AND METHOD FOR ACQUIRING THE POWER OF A PNEUMATIC DRIVE

FIELD OF THE INVENTION

The invention relates to a pneumatic drive having a working space, in which a piston is movably disposed. The piston is coupled to a path transducer. In addition, the pneumatic drive includes a pressure sensor for acquiring an internal pressure existing in the working space. In addition, the invention relates to a method for acquiring the power of such a pneumatic drive.

TECHNICAL BACKGROUND

The energy converted and "consumed" in this sense by a pneumatic component, in particular by a pneumatic drive, is usually determined based on the consumption of compressed air thereof. To this, an air consumption gauge is employed, with the aid of which the mass flow converted by the pneumatic component is determined. However, air consumption gauges are comparatively expensive components such that it is desirable to find a more inexpensive way to determine the energy consumed by a pneumatic component.

SUMMARY

It is an object of the invention to specify a pneumatic drive, the power of which can be inexpensively determined. In addition, it is an object of the invention to specify an inexpensive method for determining the power of a pneumatic drive.

According to an aspect of the invention, a pneumatic drive with a working space is specified, in which a piston is movably disposed. The pneumatic drive includes a path transducer for acquiring a path distance traveled by the piston in the working space. In addition, the pneumatic drive has a pressure sensor provided for acquiring an internal pressure in the working space. The pneumatic drive is provided with an evaluation unit adapted to determine a power of the pneumatic drive. This evaluation unit is configured such that the power of the pneumatic drive can be determined based on at least one value for the path distance traveled by the piston in the working space and a variation of the internal pressure in the working space associated with this movement.

In modern pneumatic drives, a path transducer is frequently present, which serves for determining or monitoring a position of the piston in a working space. It is inexpensively possible also to integrate a pressure sensor in the drive, if it is not provided for monitoring the chamber pressure anyway. In case of doubt, both sensors can also be integrated in a pneumatic drive with only little overhead. Thus, in such a pneumatic drive, it is readily possible to acquire measured values for the chamber internal pressure and a path distance traveled by the piston in the working space. The values are accessible for an evaluation unit, which processes this data and calculates an energy consumption of the pneumatic drive from it.

In case the pneumatic drive is already provided with an evaluation unit for other reasons, it is additionally inexpensively possible to configure this already present evaluation unit for the additionally provided energy consumption measurement. Thus, this additional function can for example be given to the evaluation unit by implementing a suitable new software. It can resort to the values metrologically accessible in the system and determine the power and the energy consumption, respectively, of the pneumatic drive based on them. The use of an expensive air consumption gauge or mass flow meter can be advantageously omitted. With a pneumatic drive according to aspects of the invention, it is instead only required to integrate an inexpensive pressure sensor and to correspondingly program the evaluation unit. Compared to conventional systems, this presents a significant economical advantage. The current power and the energy consumption of the pneumatic drive can be simply and inexpensively determined.

The determination of the power and the energy consumption of the pneumatic drive is performed on the practical assumption that the used process fluid, thus for example air, behaves as an ideal gas. In addition, it is assumed that the state variations occur in isothermal manner. Based on the ideal gas law, by means of the measured volume variation and the corresponding pressure variation, the energy consumed by the drive is determined based on the pneumatic power, which is supplied to the drive via the process fluid.

In particular, the pneumatic drive can be adapted such that the path distance traveled by the piston in the working space corresponds to a stroke of the piston. In other words, thus, the traveled path distance between end positions of the piston opposite to each other is determined by the path transducer.

In addition, the pneumatic drive can be adapted to acquire both the path distance and the internal pressure, optionally also one of the two measured values, as a time-dependent value. Correspondingly, the sensors, thus the path transducer and the pressure sensor, are adapted to acquire time-dependent values. The evaluation unit is correspondingly configured to process these time-dependent values for the path distance and the internal pressure to determine a current power of the pneumatic drive in this manner. According to a further embodiment, the energy consumption of the drive is determined by the evaluation unit temporally integrating the current power of the pneumatic drive.

According to a further embodiment, the evaluation unit is adapted to determine the power of the drive based on the time derivative of the product of the pressure existing in the working space and a working volume. In this context, the working volume is defined as a volume, which is displaced or released by the movement of the piston in the working space. In addition, the evaluation unit can be adapted to determine the working volume based on the path distance traveled by the piston in the working space and a cross-sectional area occupied by the piston in the interior space. If the cross-sectional area of the piston is assumed to be known, thus, the working volume can be determined indirectly via the path of the piston in the working space acquired by the path transducer.

According to a further embodiment, the evaluation unit is adapted to consider also a dead volume of the pneumatic drive besides the working volume for determining the power of the pneumatic drive. This in particular relates to the determination of the fluidic power of single-acting pneumatic drives. Within the scope of the calculation of the fluidic power, the dead volume can be added to the working volume, before this sum is multiplied by the chamber pressure. As already mentioned in the previous paragraph, subsequently, the time derivative of this product can be formed for determining the power of the pneumatic drive.

Corresponding to further embodiments, the measured values can be acquired over a longer period of time. Thus, the energy consumption of the pneumatic drive can also be considered over a longer period of time. The current values for the energy consumption can greatly fluctuate on short time scales due to the specific operation of the pneumatic drive. A time-averaged value of the energy consumption can be the value more meaningful for the user in some cases.

According to a further embodiment, if the energy consumption and/or the power are considered over long periods of time, thus, an average energy consumption and an average power can be determined, respectively. They virtually represent experience values, which can be used for state monitoring of the pneumatic drive. Usually, a short-term or erratic varying energy consumption indicates a malfunction of the drive if reasons for this variation are not known. Based on the detection of such an erratic variation, a corresponding error signal can be output, which for example causes examination of the concerned pneumatic drive.

According to a further embodiment, the pneumatic drive is a double-acting drive. It includes two working spaces disposed opposing each other with respect to the piston. A pressure sensor is associated with each of the two working spaces, in particular a pressure sensor can be integrated in each of the working spaces. The respective pressure sensors are configured for determining the chamber internal pressure in the first and in the second working space, respectively. With such a double-acting pneumatic drive, the evaluation unit is adapted to determine the power of the drive based on a sum of the first power provided by the piston in the first working space and a second power provided in the second working space. The determination of the respective power is effected analogously to the above explanations. The evaluation unit is configured such that the respective power can be determined based on at least one value for the path distance traveled by the piston in the first and the second working space, respectively, and a variation of the internal pressure in the first and the second working space, respectively, associated with this movement respectively. Since the path distances of the piston in the first and in the second working space are identical except for their sign, the pneumatic drive in particular only has one path transducer, but two separate pressure gauges.

According to the above embodiments, the power and the energy consumption of a double-acting pneumatic drive, respectively, can be advantageously determined exclusively based on the values of the path transducer and the pressure sensors for acquiring the respective chamber pressure. Following the conventional approach, a mass flow meter would also be required in a double-acting drive to determine the power of the drive. Advantageously, according to aspects of the invention, the employment thereof can be omitted. This applies independently of whether the pneumatic drive is a single-acting or a double-acting drive.

According to a further embodiment, the evaluation unit of the pneumatic drive can additionally be adapted to determine a fluidic and/or a mechanical efficiency of the pneumatic drive. The determination of the fluidic and/or the mechanical efficiency is also effected based on at least one value for the path distance traveled by the piston in the working space and at least one value for a variation of the internal pressure associated with this movement.

According to the above embodiment, it is advantageously possible to determine not only the power and the energy consumption, but also the efficiency of the pneumatic drive. In this context too, the employment of mass flow meters can be omitted. The efficiency of a pneumatic drive represents valuable information with regard to the energetic optimization of the pneumatic drive. In particular in large fluidic systems including a plurality of different drives, values for the efficiency of an individual drive are information of interest. Thus, for example, the overall efficiency of the fluidic system can be optimized by adapting and optimizing the individual drives, which can imply a considerable potential for savings considered in sum.

According to an embodiment, the evaluation unit of the pneumatic drive is adapted to determine the fluidic efficiency based on a quotient of a pressure-volume variation power and a fluidic power of the drive. According to a further embodiment, the evaluation unit of the pneumatic drive is adapted to determine the mechanical efficiency based on a quotient of a mechanical power provided by the movement and the pressure-volume variation power.

The fluidic efficiency is a measure of which portion of the input pneumatic power is actually performed on the working volume. Only the pressure-volume variation power can potentially be converted into mechanical power. Thus, the fluidic efficiency represents an upper limit for the mechanical efficiency of the pneumatic drive maximally to be achieved.

The mechanical efficiency is defined by the ratio of the provided mechanical power to the input fluidic power. The mechanical power of the pneumatic drive is the power performed by the movement of the piston on an external counterforce. For example, this counterforce is caused by the applied pressure of a medium to be regulated.

According to a further embodiment, the mechanical power can also be determined exclusively based on the measured values already present in the pneumatic drive, thus the path distance of the piston and the chamber pressure. This calculation is effected by inferring the force applied to the piston rod based on the chamber internal pressure and the cross-sectional area of the piston assumed to be known. Since the path distance of the piston in the working space is also acquired, it is possible to determine the mechanical work (i.e. force times path) based on the chamber internal pressure and the path distance traveled by the piston. The mechanical power results from this force multiplied by the piston speed, the latter can also be inferred from the path distance of the piston.

The mentioned efficiencies are usually not temporally constant. Frequently, they are dependent on the current operating state of the pneumatic drive. For example, the efficiency can be dependent on the applied load or the position of the piston. In order to reduce the influence of these fluctuations, the efficiency can be averaged or defined over a certain operating cycle of the drive. For this purpose, the evaluation unit can be adapted to determine the fluidic and/or the mechanical efficiency of the pneumatic drive based on a quotient of performed works. According to this embodiment, the concerned works are calculated from the associated powers by temporal integration. This integration can for example be defined over a procedure of the operating states: "opened-closed-opened". However, it is readily possible to find other suitable operating cycles, over which the power of the pneumatic drive can be temporally integrated.

The consideration of the different efficiencies (fluidic efficiency and mechanical efficiency) of the pneumatic drive allows quantifying the occurring power loses. For example, they can be caused by the dead volume of the drive, but also by occurring friction forces.

For improving the efficiency of a single-acting pneumatic drive, a fill body can be disposed in the working space. This fill body reduces the dead volume of the drive. Thus, the energy consumption of the drive can be optimized. The user obtains a corresponding indication that a potential of optimization is present based on the determined efficiencies. In times of increasing energy cost, this presents valuable information for him.

According to a further aspect of the invention, a method for acquiring the power of a pneumatic drive is specified. The pneumatic drive includes a working space, in which a piston is movably disposed. In addition, the pneumatic drive includes a path transducer for acquiring a path distance traveled by the piston in the working space and a pressure sensor for acquiring an internal pressure in the working space. At least one value for the path distance traveled by the piston in the working space is acquired. For example, this path distance can be a stroke of the piston in the working space. In addition, at least one value for a variation of the internal pressure in the working space associated with this movement of the piston in the working space is acquired. Both the at least one value for the path distance and the at least one value for the variation of the internal pressure can be acquired as time-dependent values. The acquired values are subsequently further processed to determine a power of the pneumatic drive.

According to an embodiment, for determining the power of the pneumatic drive, a time derivative of the product of the internal pressure existing in the working space and a working volume is determined. Therein, the working volume is that volume, which is displaced or released by the movement of the piston in the working space. The working volume can be determined based on the path distance traveled by the piston in the working space and a cross-sectional area occupied by the piston in the working space. In addition, in determining the power, a dead volume of the pneumatic drive can be taken into account besides the working volume. Based on the current power of the pneumatic drive, the energy consumption thereof can be determined by temporal integration of the power.

According to a further embodiment, the method includes determining a fluidic and/or a mechanical efficiency of the pneumatic drive.

The determination of the fluidic and/or the mechanical efficiency of the pneumatic drive is effected only based on the values for the path distance traveled by the piston in the working space and the values for a variation of the internal pressure existing in the working space associated with this movement of the piston in the working space.

In determining the fluidic efficiency, the quotient of a pressure-volume variation power and a fluidic power can be determined. According to a further embodiment, for determining the mechanical efficiency, the quotient of a mechanical power and a fluidic power is determined.

Since the efficiencies can be dependent on the current operating state of the pneumatic drive, according to a further embodiment, a quotient of the respectively performed works can be determined for determining these efficiencies. These works are determined from the associated powers by temporal integration over a predetermined operating cycle of the drive. For example, such an operating cycle can be composed of the operating procedure: "opening—closing—opening".

For improving the efficiency of a single-acting drive, in addition, a fill body can be disposed in the working space.

According to a further embodiment, the energy consumption of the pneumatic drive is determined by integration of the determined power over the time. In particular, a temporal average value of the power and/or the energy consumption can be determined in a predetermined time interval. An erratic deviation of the current value for the power and/or the energy consumption from the corresponding average value can be assessed as an indication of a malfunction of the pneumatic drive such that a corresponding error message can be output.

Further aspects and advantages, as they were already mentioned with regard to the pneumatic drive, also apply to the method for acquiring the power of a pneumatic drive in identical or similar manner, and therefore are not to be repeated.

BRIEF DESCRIPTION OF THE DRAWINGS

Further advantageous aspects of the invention are apparent from the following description of preferred embodiments with reference to the drawings.

DETAILED DESCRIPTION OF THE EMBODIMENTS

Figure 1:
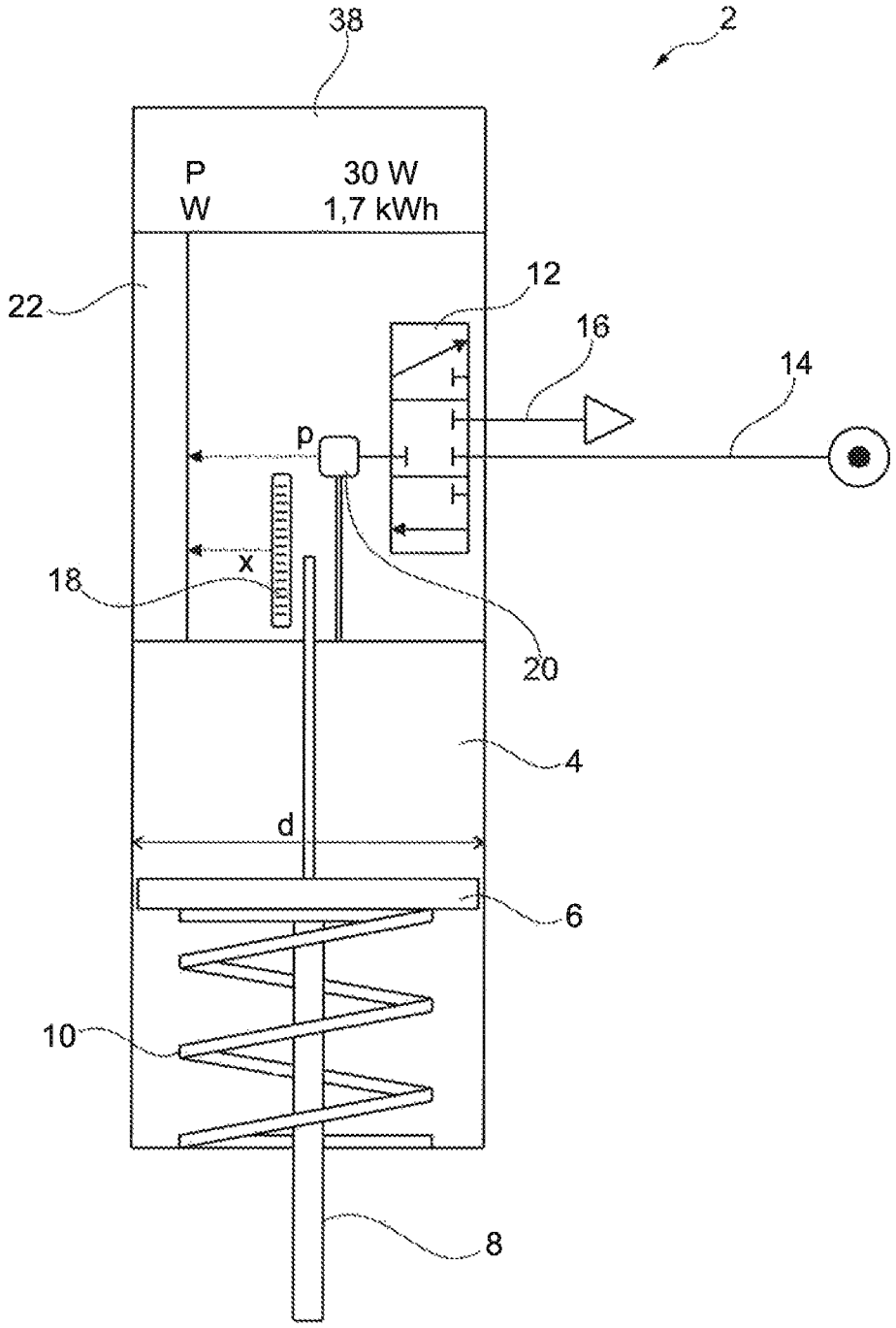
FIG. 1 is a simplified, schematic illustration of a pneumatic drive according to an embodiment.

FIG. 1 is a simplified, schematic illustration of a pneumatic drive 2 according to an embodiment. It includes a working space 4, in which a piston 6 is movably disposed. The piston 6 is connected to a piston rod 8, on which the power or work provided by the pneumatic drive 2 can be transferred to a further unit. For example, a valve or a slider of a fluidic system can be actuated with the pneumatic drive 2. A further possibility is the use of the pneumatic drive 2 as a linear drive.

The embodiment of FIG. 1 shows a single-acting pneumatic drive 2. The piston 6 cooperates with a return spring 10, which keeps it in its starting position or returns it into its starting position. In order to provide a force for actuating a component connected to the pneumatic drive 2 on the piston rod 8, the working space 4 is pressurized. For this purpose, the pneumatic drive 2 includes a 3/3-way valve 12. Alternatively to a 3/3-way valve, two 3/2-way valves or generally an adjusting system can also be employed. The valve or the adjusting system is coupled to a fluidic supply line 14, for example a compressed air line, and to a fluidic disposal line 16, for example a compressed air return line, on the input side.

Following the conventional approach, the power and the energy consumption of a pneumatic drive, respectively, are determined based on the input power of the fluidic mass flow with the aid of a mass flow meter. The fluidic power is given by the following relation:

$$P_{fluid}=\dot{m}R_S T.$$

In other words, the fluidic power of the pneumatic drive is determined by acquiring the time derivative of the mass flow and the temperature of the compressed air.

According to aspects of the invention, an approach deviating from it is pursued. The calculation of the power and the energy consumption of the pneumatic drive 2 is not effected based on a measurement of the time-dependent mass flow $\dot{m}$ but based on the path distance x traveled by the piston 6 in the working space 4 and the chamber pressure p existing in the working space 4.

For this purpose, the pneumatic drive 2 includes a path transducer 18 for acquiring a position of the piston 6 within the working space 4. The path transducer 18 is in particular suitable for determining a path distance traveled by the piston 6 in the working space 4. In addition, the pneumatic drive 2 includes a pressure sensor 20, with the aid of which an internal or chamber pressure existing in the working space 4 can be measured. Both the path transducer 18 and the pressure sensor 20 are in particular suitable for acquiring time-dependent values. Both sensors 18, 20 are coupled to an evaluation unit 22, to which the values for the path distance x and the pressure p can be transmitted, as indicated in FIG. 1 with dashed arrows.

The evaluation unit 22 can be integrated in the pneumatic drive 2. However, it can also be disposed outside and distant from the actual pneumatic drive 22. For example, the evaluation unit 22 can be a part of a central controller of a fluidic system, which includes a plurality of pneumatic drives 2. The evaluation unit 22 is adapted to determine the power and the energy consumption of the pneumatic drive 2.

The alternative determination of the power of the pneumatic drive 2 pursued according to aspects of the invention advantageously omits the employment of an expensive mass flow meter. It is effected based on the assumption reasonable in practice that the ideal gas law is valid. This means that thermal effects can be neglected, and that the process fluid, thus for example air, can be treated as an ideal gas. Under these conditions, the ideal gas law applies:

$$pV=mR_ST.$$

In the above form of the ideal gas law, p denotes the pressure, V denotes the volume, m denotes the mass, T denotes the temperature and $R_S$ denotes the specific gas constant ($R_S$=287.058 J $kg^{-1}$ $K^{-1}$).

Based on the ideal gas law, the power of the fluidic mass flow is determined by:

$$P_{fluid} = \frac{d}{dt}(pV).$$

The pressure p is the chamber pressure existing in the working space 4, which is acquired with the pressure sensor 20. The volume V is determined by the following relation:

$$V = V_0 + \pi\frac{d^2}{4}x = V_0 + V_a.$$

In this equation, $V_0$ denotes the dead volume of the pneumatic drive 2. The working volume is calculated from the diameter d of the piston 6 and the path distance x traveled by the piston 6 in the working space 4, which is acquired by the path transducer 18. As the diameter d of the piston 6, that diameter is used, which the piston 6 occupies within the working space 4. The value for the diameter d is assumed to be known similarly as the dead volume $V_0$ of the pneumatic drive 2.

The fluidic power $P_{fluid}$ of the pneumatic drive 2 can therefore be calculated based on the chamber pressure p and the path distance x based on the above mentioned relations.

Figure 2:
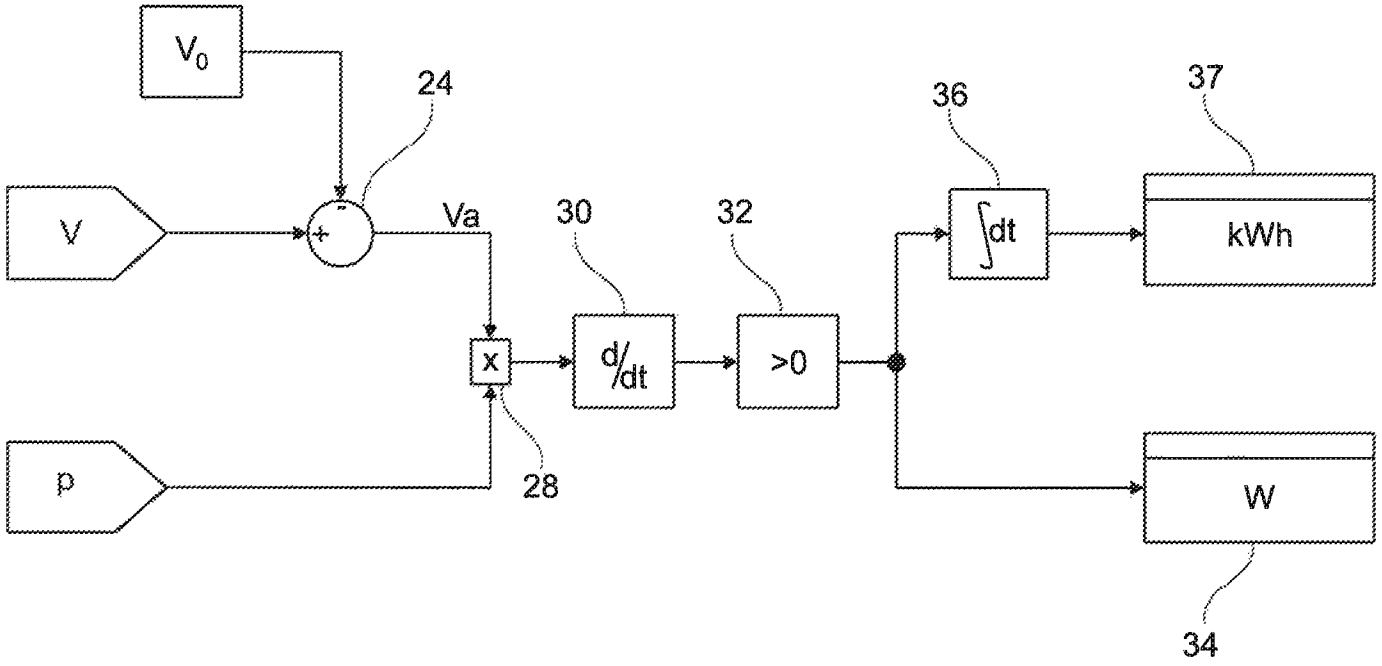
FIG. 2 is a simplified schematic flow diagram for illustrating a method for determining an energy consumption of a pneumatic drive according to an embodiment.

The calculation of the power of the pneumatic drive 2 is to be exemplarily explained for a pressure-volume variation power $P_{(p|V)}$ based on the method steps illustrated in FIG. 2. The pressure-volume variation power $P_{(p|v)}$ is the power currently provided by the pneumatic drive 2 due to the pressure and volume variation work on the working volume $V_a$.

In step 24, first, the working volume $V_a$ is calculated by subtracting the dead volume V0 from the above mentioned volume V:

$$V_a=V-V_0.$$

In practice, the working volume $V_a$ is the metrologically accessible variable because it is calculated from the diameter d of the piston 4 and the path distance x traveled by it. The working volume $V_a$ is multiplied by the pressure p existing in the working space 4 and measured with the aid of the pressure sensor 20 (step 28).

By the subsequent time derivation of this product (step 30), a pressure-volume variation power $P_{(p|v)}$ is determined according to $$P_{(p|V)} = \frac{d}{dt}(pV_a) = \dot{p}V_a + p\dot{V}_a$$

For the evaluation of $P_{(p|V)}$, exclusively positive variations are to be taken into account, wherefore it is checked in step 32 if the value of the pressure-volume variation power $P_{(p|v)}$ is positive.

Based on the value of the pressure-volume variation power $P_{(p|V)}$, which represents a current power of the drive, the energy consumption of the pneumatic drive 2 can be determined. For this purpose, an integration over the time is effected (step 36). As a result, the energy consumption of the pneumatic drive 2 can be specified in kilowatt hours (kWh) (symbolically represented by the output step 37). Alternatively or additionally, the current power of the drive can be specified, which already results after step 32. An output or display of this current power, for example in watts (W), is also symbolically represented by the output step 34.

The pneumatic drive 2 can include a rendering or display unit 38, in which both the current power and the energy consumption of the pneumatic drive 2 are displayed. Alternatively or additionally, an interface (not shown) for transmitting the concerned values to a central processing unit can be provided. It can for example be a central processing unit of a fluidic of pneumatic system.

According to a further aspect of the invention, an efficiency of the pneumatic drive 2 can be calculated. Both a fluidic efficiency $\eta_{fluid}$ and a mechanical efficiency $\eta_{mech}$ are to be determined.

The current fluidic efficiency $\eta_{fluid}$ is to be defined as follows:

$$\eta_\text{fluid} = \frac{P_{(p|V)}}{P_{fluid}}.$$

It is determined by the ratio of the pressure-volume variation power $P_{(p|v)}$ divided by the power of the fluidic mass flow $P_{fluid}$. The fluidic efficiency $\eta_{fluid}$ is a measure of which portion of the input fluidic power $P_{fluid}$ is actually performed on the working volume $V_a$. Only this portion can potentially be converted into acquired, i.e. mechanical power $P_{mech}$. Thus, the fluidic efficiency $\eta_{fluid}$ is an upper limit for the mechanical efficiency $\eta_{mech}$ of the pneumatic drive 2. The calculation of the mechanical efficiency $\eta_{mech}$ is to be elaborated in detail further below.

The fluidic efficiency $\eta_{fluid}$, as it is defined above, is not constant considered in time: it is dependent on the current operating state of the pneumatic drive 2. In particular, the fluidic efficiency $\eta_{fluid}$ is dependent on the load of the drive and the position of the piston 6 in the working space 4.

For this reason, it can be reasonable to define the fluidic efficiency $\eta_{fluid}$ over a certain operating cycle. For example, the operating cycle: "opened—closed—opened" can be selected. Such an integral fluidic efficiency $\eta_{fluid}$ results as the quotient of the works corresponding to the above mentioned powers according to the formulas:

$$\eta_{fluid} = \frac{W_{(P|V)}}{W_{fluid}}, \text{ wherein}$$

$$W_{P|V} = \int_{cycle} P_{(P|V)} dt \text{ and}$$

$$W_{fluid} = \int_{cycle} P_{fluid} dt.$$

On the further condition that friction forces do not occur in the pneumatic drive 2 or they can be neglected, a closed formulation for the fluidic efficiency $\eta_{fluid}$ of a single-acting pneumatic drive can be specified. It applies:

$$\eta_{fluid} = 1 - \frac{V_0}{V_a}\left(1 + \frac{V_0}{V_a} + \frac{F_{c,0}}{c_F x_H} + \frac{p_{atm} A_B}{c_F x_H} - \frac{F_{ext}}{c_F x_H}\right)^{-1}.$$

Besides the already mentioned variables for the dead volume $V_0$ and the working volume $V_a$, the following variables enter the calculation:

$F_{c,0}$ is the spring force of the return spring 10 in the position x=0, i.e. the piston 6 is in its upper end position and the stroke is identical to zero. $c_F$ is the spring constant of the return spring 10 and $x_H$ is the maximum stroke of the piston 6 in the working space 4. $A_B$ is the cross-sectional area of the piston 6 on the vent side, to which the atmospheric pressure $p_{atm}$ is applied. $F_{ext}$ is an external force, against which the pneumatic drive 2 works. According to the embodiment illustrated in FIG. 1, this would be that space, in which the return spring 10 is disposed if it communicates with the external environment.

The fluidic efficiency $\eta_{fluid}$ is primarily determined by the dead volume $V_0$ of the pneumatic drive 2. This is because the dead volume $V_0$ enters the calculation of the power of the fluidic mass flow $P_{fluid}$.

With single-acting pneumatic drives 2, the pneumatic power demand increases proportionally with the dead volume $V_0$. If the dead volume $V_0$ is for example of the same magnitude as the stroke or working volume $V_a$, thus, the double pneumatic power is required in order to generate an identical available power on the piston 6. With double-acting pneumatic drives, in contrast, the dead volume V0 does not have an influence on the power balance.

The mechanical efficiency $\eta_{mech}$ is to be defined via the ratio of the provided mechanical power $P_{mech}$ to the input fluidic power $P_{fluid}$ as follows:

$$\eta_{mech} = \frac{P_{mech}}{P_{fluid}}.$$

The mechanical power $P_{mech}$ is the power provided by the movement of the piston 6, for example against an external force. In many cases, this external counterforce results from an applied pressure of a medium to be regulated.

The mechanical power $P_{mech}$ is determined by:

$$P_{mech} = F_P v = pA\dot{x} = p\pi\frac{d^2}{4}\dot{x}.$$

$F_P$ is the force acting on the piston 6 and the speed v thereof. The force $F_P$ is calculated from the chamber pressure p multiplied by the area A of the piston 6. It can in turn be acquired from the diameter d thereof. The speed v of the piston 6 is the time derivative of the path distance x.

Thus, the mechanical power $P_{mech}$ can also be calculated based on the values present in the pneumatic drive 2 for the chamber pressure p and the path distance x.

As already mentioned, the value for the mechanical efficiency $\eta_{mech}$ is limited by that of the fluidic efficiency $\eta_{fluid}$. It applies $$\eta_{mech} = \frac{P_{mech}}{P_{(P|V)}}\eta_{fluid} \leq \eta_{fluid}.$$

The mechanical efficiency $\eta_{mech}$ is limited by the magnitude of the spring constant $C_F$ of the return spring 10 and the friction occurring in the pneumatic drive 2 because the force of the return spring has to be overcome as well as the occurring friction forces in addition to an external force. With single-acting pneumatic drives 2, the pneumatic power demand increases proportionally to the magnitude of the spring constant $C_F$ of the return spring 10.

The values of the efficiencies of the pneumatic drive 2 as well as the power and energy consumption thereof can be rendered in the display unit 38 (cf. FIG. 1) or transmitted to a central processing unit.

Based on the efficiency, according to a further embodiment, function monitoring of the pneumatic drive 2 can be realized. For example, the efficiency of a certain pneumatic drive 2 of a fluidic system can be recorded or observed over a longer period of time. A suddenly occurring variation of the efficiency can be interpreted as an indication of a possible malfunction of the pneumatic drive 2 if reasons for this phenomenon are not known. In addition, a low efficiency can be taken as a cause for optimization measures. For example, with a single-acting drive, for reducing the dead volume V0, which has a significant influence on the efficiency ηfluid thereof, a fill body can be disposed in the working space 4.

Figure 3:
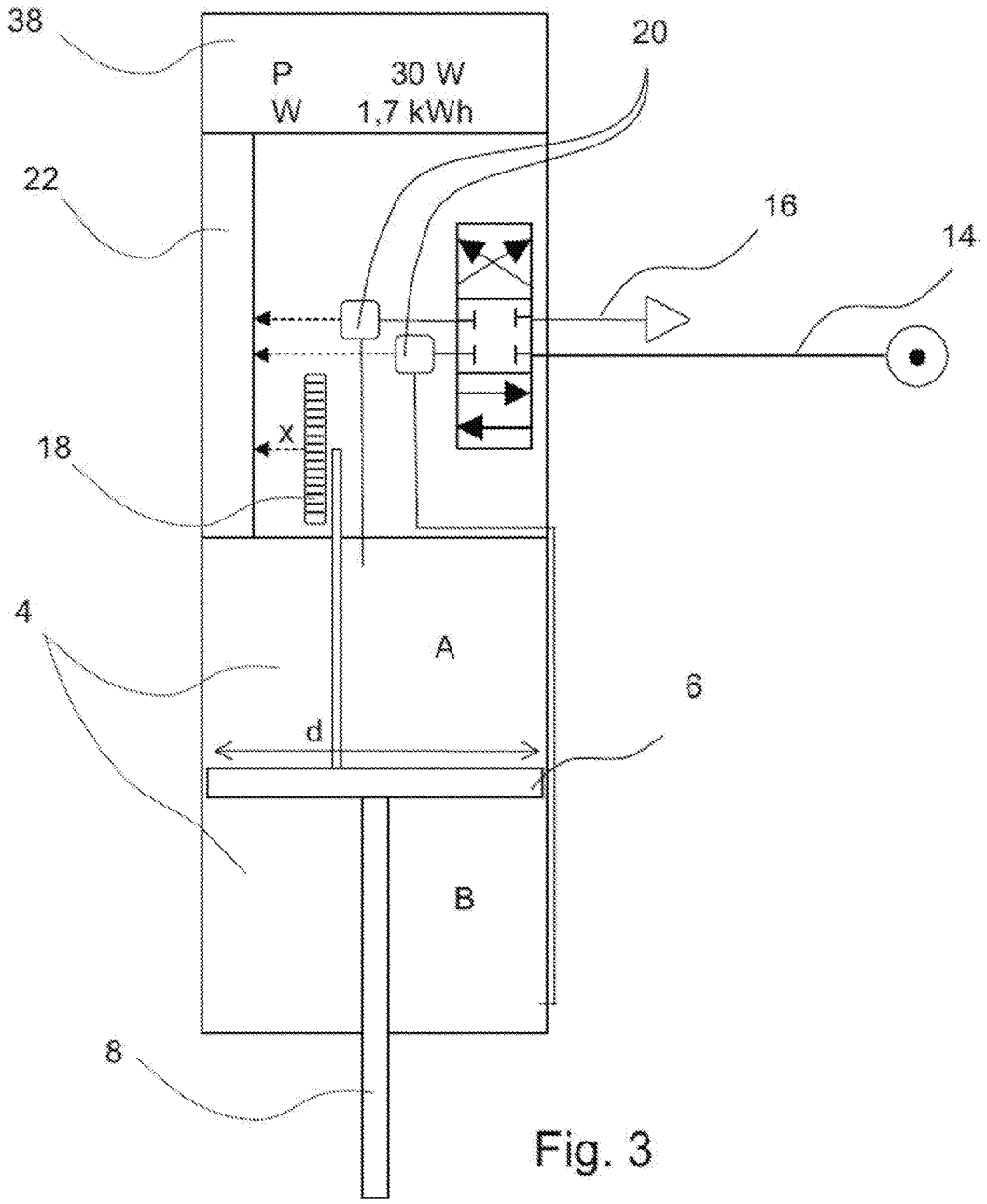
FIG. 3 is a simplified, schematic illustration of a double acting pneumatic drive according to an embodiment.

According to a further embodiment shown in FIG. 3, the pneumatic drive unlike illustrated in FIG. 1 is not a single-acting, but a double-acting pneumatic drive. Such a drive has two working spaces 4, which oppose each other with respect to the piston 6. In such an embodiment, the pneumatic drive 2 includes two pressure sensors 20, by which the chamber pressure in the first and the second working space can be acquired, respectively.

With a double-acting pneumatic drive, it basically applies to the input power of the fluidic mass flow:

$$P_{fluid} = (\dot{m}_A + \dot{m}) R_S T.$$

Variables relating to one of the two working spaces 4, are to be denoted exemplarily with indices A and B, respectively, as shown in FIG. 3. Related to the above mentioned formula, thus, $m_A$ is the mass flow in the first working space A and $m_B$ is the mass flow in the second working space B. The temperature is again denoted by T, $R_S$ is the specific gas constant. Following the conventional approach, with a double-acting pneumatic drive, a mass flow meter would also be required to acquire the magnitude of $m_A$ and $m_B$, respectively. Typically, the pneumatic line branches in two separate branches for supplying the first and the second working space, respectively. The mass flow meter is integrated in the pneumatic supply line before this branching such that the value for $m_A$ and for $m_B$ can be alternately acquired. However, this approach is expensive and therefore associated with significant cost. According to aspects of the invention, this can be advantageously avoided. Thus, compared to a single-acting drive, only a further pressure sensor for the second working space is required.

Analogously to the above explanations with respect to a single-acting drive, the ideal gas law including the assumptions made in this context again constitutes the basis for the calculation of the power and the energy consumption of the double-acting pneumatic drive. However, unlike the single-acting drive, in the double-acting drive, the operations in two working spaces are considered. Thus, it applies to the pressure-volume variation power of the double-acting drive:

$$P_{(P|V)} = \frac{d}{dt}(p_A V_{A,a} + p_B V_{B,a}).$$

$p_A$ and $p_B$, respectively, denote the pressure in the first and the second working space, respectively. Correspondingly, $V_{A,a}$ and $V_{B,a}$ are the working volume of the piston in the first and second working space, respectively.

For the evaluation of $P_{(P|V)}$, exclusively positive variations of the individual summands are to be considered. This is expressed in formulas:

$$P_{(P|V)} = \max\left(0, \frac{d}{dt}(p_A V_{A,a})\right) + \max\left(0, \frac{d}{dt}(p_B V_{B,a})\right).$$

The calculation of the fluidic and mechanical efficiency of a double-acting pneumatic drive is effected analogously to the calculation as it was already explained with regard to single-acting drives. Thus, reference can be made to the above explanations in this respect. A difference to be considered in this context is that a dead volume $V_0$ is not to be taken into account in a double-acting drive.

The invention claimed is:

1. A pneumatic drive configured to actuate a valve in a fluidic system, the pneumatic drive comprising:

at least one working space in which a piston is movably disposed to actuate the valve, a path transducer for acquiring time-dependent values for a path distance traveled by the piston in the working space, and an evaluation unit, wherein the pneumatic drive further comprises a pressure sensor for acquiring a time-dependent values for an internal pressure in the working space, wherein the evaluation unit is configured to process the time-dependent values for the path distance and the internal pressure, wherein the evaluation unit is adapted to determine a power of the pneumatic drive based on time-dependent values for the path distance traveled by the piston in the working space, a cross-sectional area occupied by the piston within the working space, and time-dependent values for a variation of the internal pressure during a movement of the piston in the working space, and wherein the evaluation unit is additionally adapted to determine a fluidic and/or a mechanical efficiency of the pneumatic drive, wherein the time-dependent values for the path distance traveled by the piston in the working space and the time-dependent values for the variation of the internal pressure during the movement of the piston in the working space are used for determining the fluidic and/or mechanical efficiency.

2. The pneumatic drive according to claim 1, wherein the evaluation unit is adapted to determine a working volume, wherein the working volume is a volume displaced or released by the movement of the piston in the working space, based on the time-dependent values for the path distance traveled by the piston in the working space and the cross-sectional area occupied by the piston within the working space.

3. The pneumatic drive according to claim 2, wherein the evaluation unit is adapted to consider a dead volume of the pneumatic drive besides a working volume for determining the power.

4. The pneumatic drive according to claim 1, wherein the pneumatic drive is a double-acting drive and a pressure sensor is present in an additional second working space disposed opposing the at least one working space with respect to the piston.

5. The pneumatic drive according to claim 4, wherein the evaluation unit is adapted to determine the power of the pneumatic drive based on a sum of a first pneumatic power provided by the piston in the at least one working space and a second pneumatic power provided in the second working space.

6. The pneumatic drive according to claim 1, wherein the pneumatic drive is a single-acting drive, and a fill body is disposed in the working space.

7. The pneumatic drive according to claim 1, wherein the evaluation unit is adapted to determine an energy consumption of the pneumatic drive by integration of the determined power over time, and to assess an erratic deviation of a current value for the power and/or the energy consumption from a corresponding average value as an indication of a malfunction of the pneumatic drive and to output a corresponding error message.

8. A method for acquiring a power of a pneumatic drive configured to actuate a valve in a fluidic system, the pneumatic drive comprising a working space in which a piston is movably disposed to actuate the valve, and a path transducer for acquiring time-dependent values for a path distance traveled by the piston in the working space, wherein the pneumatic drive further comprises a pressure sensor for acquiring time-dependent values for an internal pressure in the working space, and wherein the method includes the following steps of:

a) acquiring time-dependent values for the path distance traveled by the piston in the working space, b) acquiring time-dependent values for a variation of the internal pressure in the working space during a movement of the piston in the working space, and c) determining a power of the pneumatic drive based on the acquired time-dependent values for the path distance traveled by the piston in the working space, a cross-sectional area occupied by the piston within the working space, and the time-dependent values for the variation of the internal pressure during the movement of the piston in the working space; and d) determining a fluidic and/or a mechanical efficiency of the pneumatic drive using the time-dependent values for the path distance traveled by the piston in the working space and the time-dependent values for the variation of the internal pressure during the movement of the piston in the working space.

9. The method according to claim 8, wherein a working volume, which is displaced or released by the movement of the piston in the working space, is determined based on the time-dependent values for the path distance traveled by the piston in the working space and the cross-sectional area occupied by the piston in the working space.

10. The method according to claim 9, wherein a dead volume of the pneumatic drive is also taken into account besides the working volume for determining the power.

11. The method according to claim 8, wherein for improving the fluidic and/or the mechanical efficiency of a single-acting drive, a fill body is disposed in the working space.

12. The method according to claim 8, wherein an energy consumption of the pneumatic drive is determined by integration of the determined power over time, wherein an erratic deviation of a current value for the power and/or the energy consumption from a corresponding average value is assessed as an indication of a malfunction of the pneumatic drive and a corresponding error message is output.

13. A pneumatic drive configured to actuate a valve in a fluidic system, the pneumatic drive comprising:

at least one working space in which a piston is movably disposed to actuate the valve, a path transducer for acquiring time-dependent values for a path distance traveled by the piston in the working space, and an evaluation unit, wherein the pneumatic drive further comprises a pressure sensor for acquiring a time-dependent values for an internal pressure in the working space, wherein the evaluation unit is configured to process the time-dependent values for the path distance and the internal pressure, wherein the evaluation unit is adapted to determine a power of the pneumatic drive based on the time-dependent values for the path distance traveled by the piston in the working space, a cross-sectional area occupied by the piston within the working space, and the time-dependent values for a variation of the internal pressure during a movement of the piston in the working space, and wherein the evaluation unit is adapted to monitor the efficiency of the pneumatic drive as a function of time.

14. A pneumatic drive configured to actuate a valve in a fluidic system, the pneumatic drive comprising:

at least one working space in which a piston is movably disposed to actuate the valve, a path transducer for acquiring time-dependent values for a path distance traveled by the piston in the working space, and an evaluation unit, wherein the pneumatic drive further comprises a pressure sensor for acquiring a time-dependent values for an internal pressure in the working space, wherein the evaluation unit is configured to process the time-dependent values for the path distance and the internal pressure, wherein the evaluation unit is adapted to determine a power of the pneumatic drive based on the time-dependent values for the path distance traveled by the piston in the working space, a cross-sectional area occupied by the piston within the working space, and the time-dependent values for a variation of the internal pressure during a movement of the piston in the working space, wherein the evaluation unit is adapted to monitor the efficiency of the pneumatic drive as a function of time, wherein the evaluation unit is adapted to determine an energy consumption of the pneumatic drive by integration of the determined power over time, and wherein the evaluation unit is further adapted to assess an erratic deviation of a current value of the power and/or the energy consumption from a corresponding average value as an indication of a malfunction of the pneumatic drive and to output a corresponding error message.

15. A pneumatic drive configured to actuate a valve in a fluidic system, the pneumatic drive comprising:

at least one working space in which a piston is movably disposed to actuate the valve, a path transducer for acquiring time-dependent values for a path distance traveled by the piston in the working space, and an evaluation unit, wherein the pneumatic drive further comprises a pressure sensor for acquiring a time-dependent values for an internal pressure in the working space, wherein the evaluation unit is configured to process the time-dependent values for the path distance and the internal pressure, wherein the evaluation unit is adapted to determine a power of the pneumatic drive based on the time-dependent values for the path distance traveled by the piston in the working space, a cross-sectional area occupied by the piston within the working space, and the time-dependent values for a variation of the internal pressure during a movement of the piston in the working space, wherein the evaluation unit is adapted to determine a fluidic and/or a mechanical efficiency of the pneumatic drive, wherein only the time-dependent values for the path distance traveled by the piston in the working space and the time-dependent values for the variation of the internal pressure during the movement of the piston in the working space are used for determining the fluidic and/or mechanical efficiency, and wherein the evaluation unit is adapted to monitor the fluidic and/or a mechanical efficiency of the pneumatic drive as a function of time.

16. A pneumatic drive configured to actuate a valve in a fluidic system, the pneumatic drive comprising:

at least one working space in which a piston is movably disposed to actuate the valve, a path transducer for acquiring time-dependent values for a path distance traveled by the piston in the working space, and an evaluation unit, wherein the pneumatic drive further comprises a pressure sensor for acquiring a time-dependent values for an internal pressure in the working space, wherein the evaluation unit is configured to process the time-dependent values for the path distance and the internal pressure, wherein the evaluation unit is adapted to determine a power of the pneumatic drive based on the time-dependent values for the path distance traveled by the piston in the working space, a cross-sectional area occupied by the piston within the working space, and the time-dependent values for a variation of the internal pressure during a movement of the piston in the working space, wherein the evaluation unit is adapted to determine a fluidic and/or a mechanical efficiency of the pneumatic drive, wherein the time-dependent values for the path distance traveled by the piston in the working space and the time-dependent values for the variation of the internal pressure during the movement of the piston in the working space are used for determining the fluidic and/or mechanical efficiency, wherein the evaluation unit is adapted to monitor the fluidic and/or a mechanical efficiency of the pneumatic drive as a function of time, and wherein the evaluation unit is further adapted to assess an erratic deviation of a current value of the fluidic and/or mechanical efficiency from a corresponding average value as an indication of a malfunction of the pneumatic drive and to output a corresponding error message.

17. A method for acquiring a power of a pneumatic drive configured to actuate a valve in a fluidic system, the pneumatic drive comprising a working space in which a piston is movably disposed to actuate the valve, and a path transducer for acquiring time-dependent values for a path distance traveled by the piston in the working space, wherein the pneumatic drive further comprises a pressure sensor for acquiring time-dependent values for an internal pressure in the working space, and wherein the method includes the following steps of:

a) acquiring time-dependent values for the path distance traveled by the piston in the working space, b) acquiring time-dependent values for a variation of the internal pressure in the working space during a movement of the piston in the working space, c) determining a power of the pneumatic drive based on the acquired time-dependent values for the path distance traveled by the piston in the working space, a cross-sectional area occupied by the piston within the working space, and the time-dependent values for the variation of the internal pressure during the movement of the piston in the working space, and d) monitoring the efficiency of the pneumatic drive as a function of time.

18. A method for acquiring a power of a pneumatic drive configured to actuate a valve in a fluidic system, the pneumatic drive comprising a working space in which a piston is movably disposed to actuate the valve, and a path transducer for acquiring time-dependent values for a path distance traveled by the piston in the working space, wherein the pneumatic drive further comprises a pressure sensor for acquiring time-dependent values for an internal pressure in the working space, and wherein the method includes the following steps of:

a) acquiring time-dependent values for the path distance traveled by the piston in the working space, b) acquiring time-dependent values for a variation of the internal pressure in the working space during a movement of the piston in the working space, c) determining a power of the pneumatic drive based on the acquired time-dependent values for the path distance traveled by the piston in the working space, a cross-sectional area occupied by the piston within the working space, and the time-dependent values for the variation of the internal pressure during the movement of the piston in the working space, d) monitoring the efficiency of the pneumatic drive as a function of time, and e) determining an energy consumption of the pneumatic drive by integration of the determined power over time, and assessing an erratic deviation of a current value of the power and/or the energy consumption from a corresponding average value as an indication of a malfunction of the pneumatic drive and initiating a corresponding error message.

19. A method for acquiring a power of a pneumatic drive configured to actuate a valve in a fluidic system, the pneumatic drive comprising a working space in which a piston is movably disposed to actuate the valve, and a path transducer for acquiring time-dependent values for a path distance traveled by the piston in the working space, wherein the pneumatic drive further comprises a pressure sensor for acquiring time-dependent values for an internal pressure in the working space, and wherein the method includes the following steps of:

a) acquiring time-dependent values for the path distance traveled by the piston in the working space, b) acquiring time-dependent values for a variation of the internal pressure in the working space during a movement of the piston in the working space, c) determining a fluidic and/or a mechanical efficiency of the pneumatic drive, wherein the time-dependent values for the path distance traveled by the piston in the working space and the time-dependent values for the variation of the internal pressure during the movement of the piston in the working space are used for determining the fluidic and/or mechanical efficiency, and d) monitoring the fluidic and/or mechanical efficiency of the pneumatic drive as a function of time.

20. A method for acquiring a power of a pneumatic drive configured to actuate a valve in a fluidic system, the pneumatic drive comprising a working space in which a piston is movably disposed to actuate the valve, and a path transducer for acquiring time-dependent values for a path distance traveled by the piston in the working space, wherein the pneumatic drive further comprises a pressure sensor for acquiring time-dependent values for an internal pressure in the working space, and wherein the method includes the following steps of:

a) acquiring time-dependent values for the path distance traveled by the piston in the working space, b) acquiring time-dependent values for a variation of the internal pressure in the working space during a movement of the piston in the working space, c) determining a fluidic and/or a mechanical efficiency of the pneumatic drive, wherein the time-dependent values for the path distance traveled by the piston in the working space and the time-dependent values for the variation of the internal pressure during the movement of the piston in the working space are used for determining the fluidic and/or mechanical efficiency, d) monitoring the fluidic and/or mechanical efficiency of the pneumatic drive as a function of time, and e) assessing an erratic deviation of a current value of the fluidic and/or mechanical efficiency from a corresponding average value as an indication of a malfunction of the pneumatic drive and initiating a corresponding error message.

* * * * *